US005894948A

United States Patent [19]

Yeh

[11] Patent Number: 5,894,948

[45] Date of Patent: Apr. 20, 1999

[54] NOVELTY MUG ASSEMBLY

[76] Inventor: Frank Yeh, 1019 N. Mayflower St., Anaheim, Calif. 92801

[21] Appl. No.: 08/436,660

[22] Filed: May 8, 1995

[51] Int. Cl.[6] ..... B65D 65/00

[52] U.S. Cl. ..... 215/12.1; 220/62.12; 220/62.14; 220/62.18

[58] Field of Search ..... 220/408, 410, 220/426, 428, 460, 469, 62.18, 62.12, 62.14; 215/12.1

[56] References Cited

U.S. PATENT DOCUMENTS

| | | | |
|---|---|---|---|
| 2,863,585 | 12/1958 | Meshberg | 215/12.1 X |
| 2,895,636 | 7/1959 | Martin | 215/12.1 X |
| 3,766,975 | 10/1973 | Todd | 215/12.1 X |
| 3,827,925 | 8/1974 | Douglas | 220/12.1 X |
| 4,151,923 | 5/1979 | Bernardi | 215/12.1 |
| 4,263,734 | 4/1981 | Bradshaw | 215/12.1 X |
| 4,789,073 | 12/1988 | Fine | 220/410 X |
| 4,941,590 | 7/1990 | Pantaleo et al. | 220/428 |
| 5,040,317 | 8/1991 | Kadjevich | 220/410 X |
| 5,150,815 | 9/1992 | Saklad | 215/12.1 X |

*Primary Examiner*—Steven Pollard
*Attorney, Agent, or Firm*—Raymond Sun

[57] ABSTRACT

A mug assembly comprises an internal mug adapted to be positioned inside an external mug. The external mug comprises a substantially transparent cylindrical container wall having an outer surface and an inner surface. The internal mug comprises a substantially cylindrical container wall made of a non-plastic material and having an outer surface and a mouth. A sealing material is provided to assist in securing the internal mug inside the external mug. Decorative indicia may be provided between the inner surface of the external mug and the outer surface of the internal mug, or on the outer surface of the internal mug.

16 Claims, 4 Drawing Sheets

NOVELTY MUG ASSEMBLY

BACKGROUND OF THE INVENTION

1. Field of the Invention

The present invention relates to a novelty drinking cup or mug assembly that allows an individual to choose and change the ornamental design of the mug. In particular, the present invention relates to a drinking mug assembly that comprises two mugs, an internal mug and a transparent external mug. A decorative mat or piece or color particles suspended in a liquid may be provided between the internal and the external mugs, or the exterior of the internal mug may be decorated with a desired design or pattern.

2. Description of the Related Art

The present invention is applicable to mugs, cups and beverage containers alike, which shall hereinafter be collectively referred to as "mugs".

Certain conventional novelty drinking mug assemblies are very popular with children and adults alike. Such novelty drinking mug assemblies comprise two mugs, an internal mug and a substantially transparent external mug, with a decorative mat or piece provided in the space between the internal and the external mugs. The internal mug has an overhanging lip portion that is adapted to engage the lip at the mouth of the external mug. The decorative mat or piece may be a sheet of paper or fabric having an ornamental design, words, or a combination thereof, etched, printed or otherwise disposed on it. The decorative mat is fitted inside the external mug against the inside surfaces of the external mug. The internal mug is positioned inside the external mug, and the overhanging lip of the internal mug overhangs and engages the mouth of the external mug to hold the decorative mat in place between the two mugs. Instead of a decorative mat, some novelty drinking mug assemblies have provided particles of different colors that are suspended in a liquid that is captured between the two mugs.

These novelty drinking mug assemblies are popular because they allow an individual to choose or change the ornamental design of the drinking mug assembly. For instance, an individual may provide a decorative piece of paper having a particular ornamental design or written message. At a later time, this same individual may decide to sew an ornamental pattern onto a fabric or other mat, and then substitute this mat for the previous piece of decorative paper. Thus, the individual is provided with an unlimited variety of different ornamental designs and messages that he or she can provide to the same drinking mug assembly.

The internal and external mugs of such conventional novelty drinking mug assemblies are typically made from plastic. In particular, the external mug must be made from a substantially transparent material to allow the decorative mat or suspended color particles to be visible. The internal mug can be any color but preferably a neutral color so as to provide a good background for the decorative mat or suspended color particles. In any case, plastic is typically used for both the internal and the erternal mugs because plastic can be easily molded to form the desired overhanging lip and to ensure an effective snap-fit engagement between the overhanging lip of the internal mug and the mouth of the external mug. This snap-fit engagement is easily accomplished because plastic is a flexible material which can be flexed or deformed to snap the overhanging lip over the mouth of the external mug.

Unfortunately, the use of plastic as a material for a cup or mug has several drawbacks. First, plastic surfaces are often more difficult to clean effectively than surfaces made from other materials such as ceramic, glass or porcelain. Second, people have complained that plastic mugs impart an unpleasant odor, while ceramic, glass or porcelain mugs do not carry such an odor. Third, plastic is not effective in retaining the temperature of the fluid contained in the mug, while ceramic, glass or porcelain mugs are somewhat more effective in retaining the temperature of the fluid. Fourth, plastic mugs are susceptible to leakage due to cracks or other deformities, so that when used with the novelty drinking mug assemblies described above, there is a danger that contaminants or the liquid captured between the two mugs may leak into the drinking liquid if the internal mug leaks or is deformed. For the purposes of the present invention, the term "plastic" is meant to include flexible, lightweight, synthetic materials such as polyethylene, polypropylene, or similar materials.

Despite these recognized drawbacks of plastic, both the internal and the external mugs of these novelty drinking mug assemblies are still made from plastic because the other materials such as ceramic, glass or porcelain are not flexible enough to provide an effective snap-fit engagement mechanism between the internal and the external mugs. Thus, there is still a need for a novelty drinking mug assembly in which at least the internal mug, and preferably also the external mug, are made of a non-plastic material such as ceramic, porcelain or glass, and which provides a safe, effective, and convenient mechanism for engaging the internal and external mugs to hold a decorative mat or liquid therebetween.

SUMMARY OF THE INVENTION

The objects of the present invention may be achieved by providing, in a first preferred embodiment, a mug assembly comprising an internal mug adapted to be positioned inside an external mug. The external mug comprises a substantially transparent cylindrical container wall having an outer surface and an inner surface, the external mug further comprising a mouth having a substantially circular upper edge, and a sealing ring or a plurality of sealing strips attached adjacent to the upper edge of the external mug on the outer surface thereof. The internal mug comprises a substantially cylindrical container wall made of a non-plastic material and having an outer surface and a mouth. The internal mug further comprises an annular overhanging lip extending outwardly from its mouth, with the overhanging lip comprising an internal surface. The overhanging lip defines a first gap which is adapted to overhang the upper edge of the external mug and to engage the mouth of the external mug and the sealing ring or sealing strips. The sealing ring or each sealing strip comprises an outer surface that is adapted to frictionally engage the internal surface of the overhanging lip to secure the internal mug to the mouth of the external mug. The diameter of the outer surface of the internal mug is smaller than the diameter of the inner surface of the external mug so that a second gap is defined when the internal mug is positioned inside the external mug.

The mug assembly according to a second preferred embodiment of the present invention comprises an internal mug adapted to be positioned inside an external mug. The external mug comprises a substantially transparent and cylindrical container wall having an inner surface. The external mug further comprises a mouth having a substantially circular upper edge, and an annular groove provided in the inner surface adjacent to the upper edge of the external mug. The internal mug comprises a substantially cylindrical container wall made of a non-plastic material and having an outer surface and a substantially circular upper edge. The internal mug further comprises an annular sealing ring or a plurality of sealing strips attached adjacent the upper edge of the internal mug on the outer surface thereof and adapted to be fitted inside the annular groove of the external mug. The sealing ring or each sealing strip comprises an outer surface that is adapted to frictionally engage the annular groove and the internal surface of the external mug to secure the internal mug to the mouth of the external mug. The internal mug further comprises an annular lip adapted to engage the inner surface of the external mug adjacent the mouth of the external mug when the internal mug is positioned inside the external mug. The diameter of the outer surface of the internal mug is smaller than the diameter of the inner surface of the external mug so that a second gap is defined when the internal mug is positioned inside the external mug.

The mug assembly according to a third preferred embodiment of the present invention is similar to the second preferred embodiment except that the annular groove in the inner surface of the external mug and the annular lip of the internal mug are omitted. The frictional contact between the outer surface of the sealing ring or sealing strips and the inner surface of the external mug is used to secure the internal mug in place inside the external mug.

The internal mug according to the present invention is made from a material selected from the group consisting of ceramic, porcelain, earthenware, stoneware or glass.

In another embodiment of the mug assembly according to the present invention, a decorative piece having an ornamental design provided thereon is positioned between the inner surface of the external mug and the outer surface of the internal mug. In yet another embodiment of the mug assembly according to the present invention, a plurality of color particles are suspended in a liquid captured between the outer surface of the internal mug and the inner surface of the external mug. In a further embodiment of the mug assembly according to the present invention, an ornamental design is provided on the outer surface of the internal mug.

Thus, the novelty mug assemblies of the present invention provide a non-plastic internal mug that can be effectively secured to an external mug. The non-plastic internal mug is made from a material which overcomes the drawbacks of plastic. For example, the non-plastic internal mug can be easily and effectively washed after it has been detached from the external mug, do not carry an unpleasant odor, is effective in retaining the temperature of the fluid contained in the mug, and is less susceptible to cracks or other deformities. Because of its simple design and construction, the mug assemblies according to the present invention are also easy to manufacture and easy to use. Further, the materials used to fabricate the internal and external mugs are inexpensive, so that the mug assemblies can be provided at low cost.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
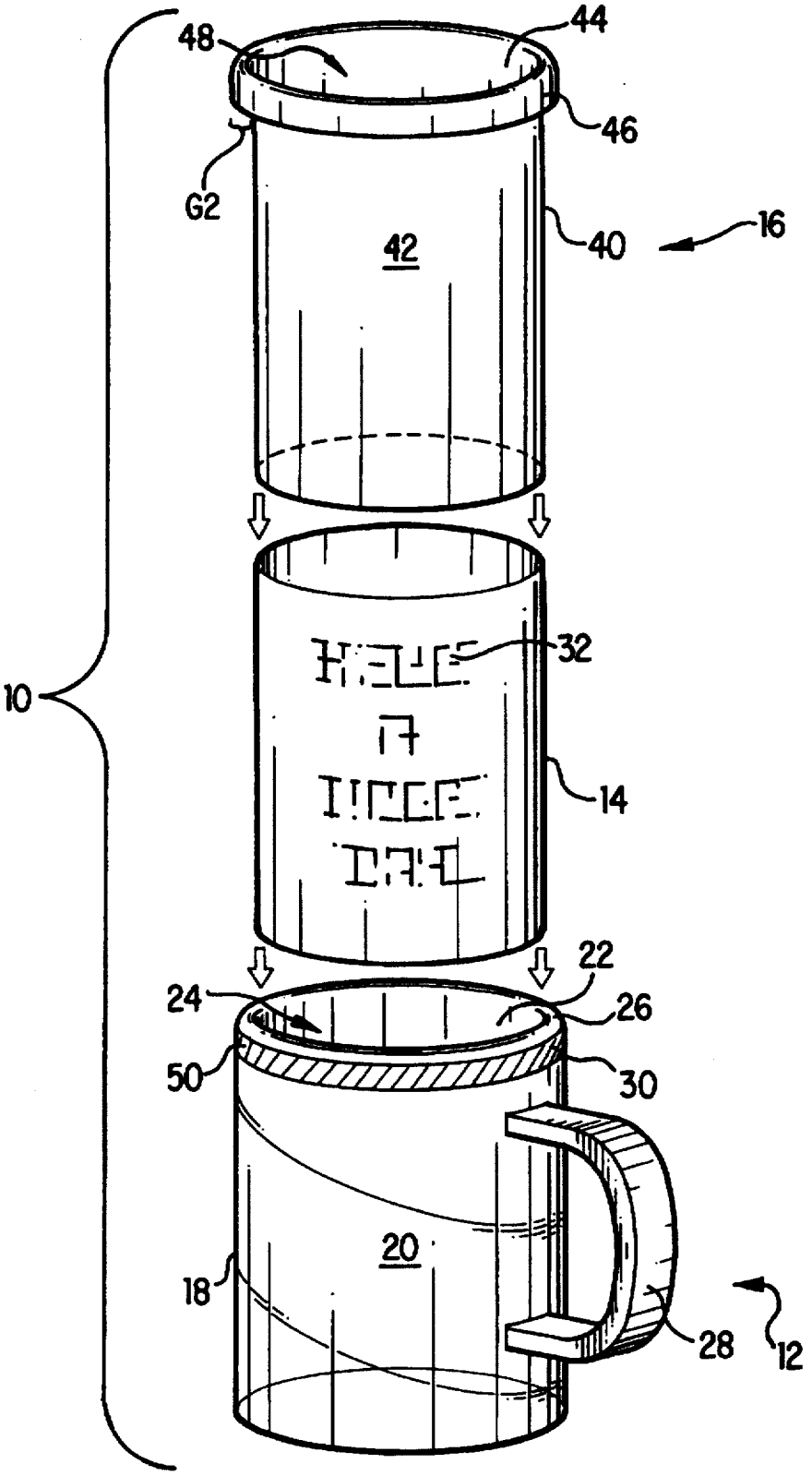
FIG. 1 is an exploded perspective view of a first embodiment of a novelty drinking mug assembly according to the present invention.

The novelty drinking mug assembly 10 in accordance with a first preferred embodiment of the present invention is shown in FIG. 1 and comprises an external mug 12, a decorative mat or piece 14, and an internal mug 16.

The external mug 12 comprises a substantially cylindrical container wall 18 having an outer surface 20 and an inner surface 22. The container wall 18 must be substantially transparent to display the decorative mat 14. The external mug 12 further comprises a mouth 24 having a substantially circular upper edge 26. A handle 28 is provided on the outer surface 20 for the individual to grip the mug assembly 10. An annular sealing ring 30 is attached adjacent to the upper edge 26 of the mug 12 on the outer surface 20. The features and functions of this sealing ring 30 shall be explained in greater detail hereinbelow.

Figure 3:
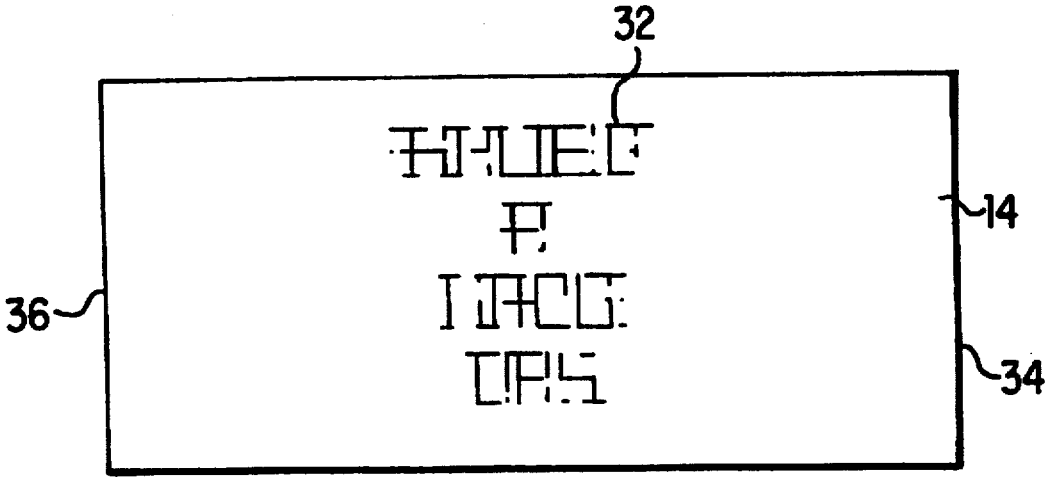
FIG. 3 is a front plan view of the decorative mat of the mug assembly of FIG. 1.

The decorative mat 14 comprises a piece of paper, fabric mat, or P.V.C. sheet that has been rolled into a cylindrical shape. Referring to FIG. 3, the mat 14 may be provided as a flat piece without any ornamental design or message provided thereon, so that the individual can sew, draw or otherwise create an ornamental design or message 32 on the mat 14 before rolling the mat 14 to create the cylindrical shape. The mat 14 preferably has a length that allows it to be rolled into a cylindrical shape having a diameter which is substantially the same as the diameter of the inner surface 22 of the mug 12, so that the cylindrically-shaped mat 14 can be positioned against the inner surface 22. In this regard, the mat 14 can be provided at a length such that both ends 34 and 36 slightly overlap each other, thereby ensuring that the entire circumference of the container wall 18 will be covered by the mat 14. Both ends 34 and 36 may be left free or attached without departing from the spirit and scope of the present invention. The height of the mat 14 is preferably slightly less than the height of the mug 12 by the thickness of the sealing ring 30, so that substantially the entire mat 14 can be displayed through the container wall 18.

Alternatively, the mat 14 may be provided in its cylindrical shape with an ornamental design already provided thereon. In this regard, a plurality of mats 14 having different ornamental designs and messages can be provided, so that the individual can choose between the different mats, and can substitute different mats at different times to enhance the variety of the design of the mug assembly 10.

Figure 4:
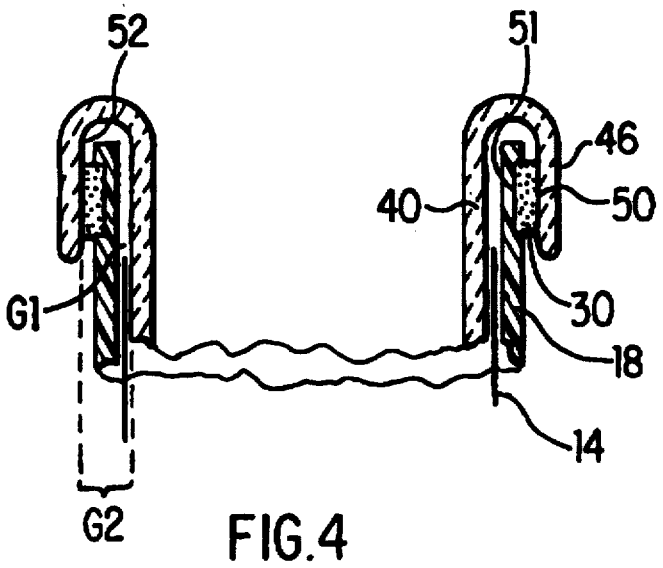
FIG. 4 is a partial cross-sectional view of the mug assembly of FIG. 1.

The internal mug 16 comprises a substantially cylindrical container wall 40 having an outer surface 42 and an inner surface 44. Referring to FIG. 4, the diameter of the outer surface 42 is preferably smaller than the diameter of the inner surface 22 of the external mug 12 so that a small gap G1 is defined when the internal mug 16 is positioned inside the external mug 12. The internal mug 16 further comprises an annular overhanging lip 46 extending outwardly from its mouth 48. The diameter of the overhanging lip 46 is preferably larger than the diameter of the sealing ring 30, and the overhanging lip 46 defines a gap G2 which is adapted to engage the mouth 24 of the external mug 12 and its sealing ring 30.

Figure 7:
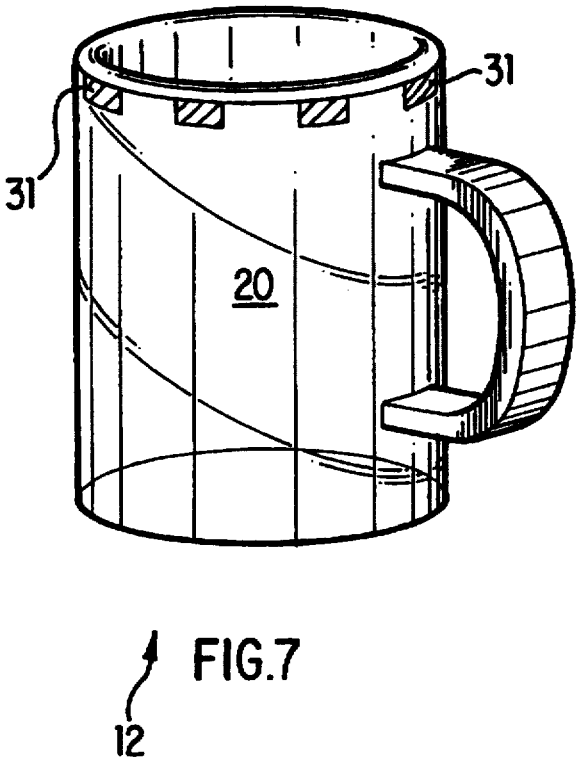
FIG. 7 is a perspective view of the external mug of FIG. 1 showing a modification made thereto.

The material of the sealing ring 30 has a resiliency which holds the sealing ring 30 tightly against the wall 18 of the external mug 12. The sealing ring 30 is preferably attached to the wall 18 by fitting it into a groove 51 provided in the wall 18 (see FIG. 4), so that its resiliency holds it in the groove 51 and firmly against the wall 18. Alternatively, the sealing ring 30 may be adhered to the outer surface 20 by a non-toxic adhesive, or by other conventional attachment methods. An outer surface 50 of the sealing ring 30 is adapted to frictionally engage the inner surface 52 of the overhanging lip 46 of the internal mug 16 to form a tight fit thereat. The sealing ring 30 is preferably made from a resilient and flexible non-toxic material such as but not limited to rubber, silicon, or polyethylene. Alternatively, referring to FIG. 7, instead of the sealing ring 30, a plurality of strips 31 of sealing material made from the same material as the sealing ring 30 may be attached in spaced-apart manner around the outer surface 20 of the wall 18 by a non-toxic adhesive. The number of strips 31 used and their sizes can be varied as desired as long as sufficient frictional engagement is imparted to engage the mouth 24 of the external mug 12.

The internal mug 16 is preferably made from a non-plastic material such as ceramic, porcelain, stoneware, earthenware or glass. As explained above, these materials do not suffer from the known drawbacks of plastic. The material of the external mug 12 is not critical, and can comprise plastic, ceramic, glass, stoneware, earthenware or porcelain.

Referring now to FIGS. 1 and 4, the mug assembly 10 is assembled by first positioning the decorative mat 14 inside the external mug 12 adjacent the inner surface 22. The internal mug 16 is then positioned inside the external mug 12 so that the mat 14 is captured in the gap G1 between the outer surface 42 of the internal mug 16 and the inner surface 22 of the external mug 12. To secure the internal mug 16 inside the external mug 12, the overhanging lip 46 of the internal mug 16 is pushed downwardly so that the overhanging lip 46 overhangs the upper edge 26 of the mouth 24 of the external mug 12 and its sealing (or sealing strips 31) ring 30 and causes the upper edge 26 and sealing ring 30 (or sealing strips 31) to be engagingly received inside the gap G2 of the overhanging lip 46. The outer surface 50 of the sealing ring 30 (or sealing strips 31) frictionally engages the inner surface 52 of the overhanging lip 46 to tightly engage the internal mug 16 and the external mug 12. When secured in this position, the overhanging lip 46 completely covers the sealing ring 30 (or sealing strips 31) so that it is not visible to the individual.

Instead of the decorative mat 14, the individual can fill the external mug 12 with a small volume of water or other liquid, and then sprinkle in a few color particles. The internal mug 16 can then be fitted inside the external mug 12 and secured therein by the method described above so that the ornamental design of this mug assembly would comprise color particles suspended in a liquid in the gap G1 between the two mugs 12 and 16.

To remove or substitute the decorative mat 14, the individual merely grips the overhanging lip 46 and lifts the internal mug 16 out of the external mug 12, and removes the decorative mat 14. The removal of the internal mug 16 can be easily accomplished because the frictional engagement between the outer surface 50 of the sealing ring 30 (or sealing strips 31) and the inner surface 52 of the overhanging lip 46, although tight, does not require much lifting force to overcome. The individual can then install another decorative mat 14 having a different ornamental design or message.

Figure 2:
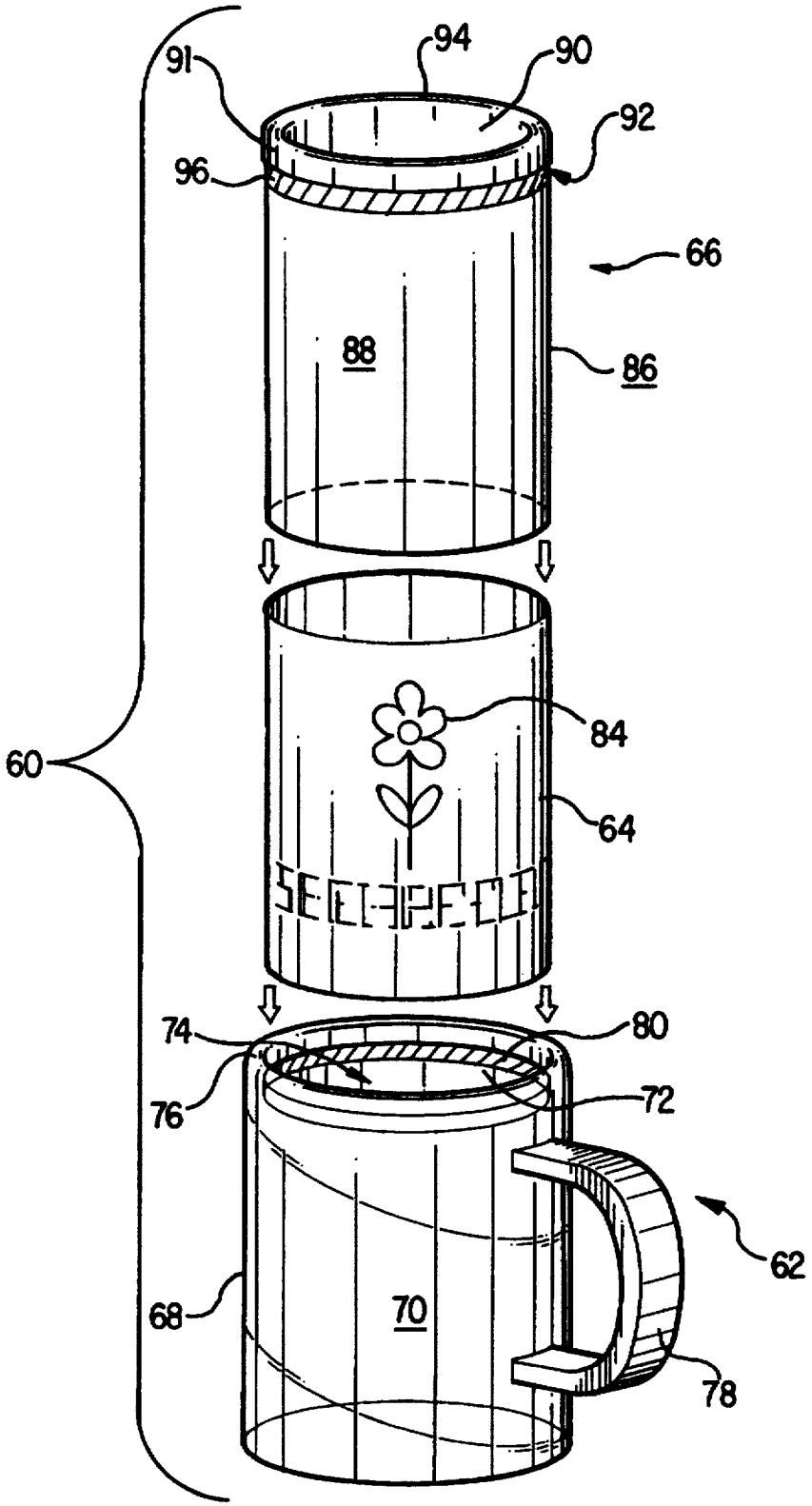
FIG. 2 is an exploded perspective view of a second embodiment of a novelty drinking mug assembly according to the present invention.

The novelty drinking mug assembly 60 in accordance with a second preferred embodiment of the present invention is shown in FIG. 2 and comprises an external mug 62, a decorative mat or piece 64, and an internal mug 66. The external mug 62 comprises a substantially cylindrical container wall 68 having an outer surface 70 and an inner surface 72. The container wall 68 must be substantially transparent to display the decorative mat 64. The external mug 62 further comprises a mouth 74 having a substantially circular upper edge 76. A handle 78 is provided on the outer surface 70 for the individual to grip the mug assembly 60. An annular groove 80 is provided in the inner surface 72 adjacent to but slightly offset from the upper edge 76.

The decorative mat 64 is the same in structure and function as the decorative mat 14 shown and described above. In FIG. 2, the decorative mat 66 is shown as having a different ornamental design and message 84. The height of the mat 64 is preferably such that the entire mat 64 can be fitted under the annular groove 80 of the external mug 62.

Figure 5:
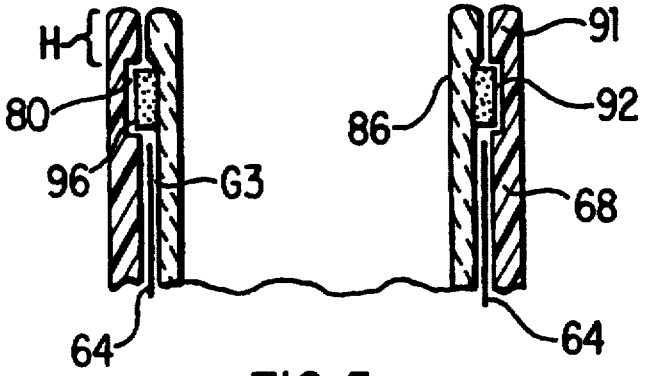
FIG. 5 is a partial cross-sectional view of the mug assembly of FIG. 2.
Figure 8:
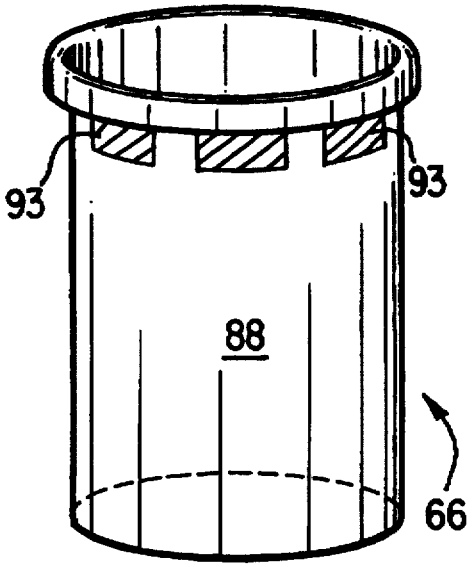
FIG. 8 is a perspective view of the internal mug of FIG. 2 showing a modification made thereto.

The internal mug 66 comprises a substantially cylindrical container wall 86 having an outer surface 88 and an inner surface 90. Referring to FIG. 5, the diameter of the outer surface 88 is preferably smaller than the diameter of the inner surface 72 of the external mug 62 so that a small gap G3 is defined when the internal mug 66 is positioned inside the external mug 62. The upper edge 94 of the internal mug 66 comprises an annular lip 91 having a thickness that is greater than the thickness of the container wall 86. An annular sealing ring 92 is attached adjacent to the upper edge 94 of the mug 66 on the outer surface 88 below the annular lip 91. The features and functions of this sealing ring 92 are the same as the sealing ring 30 described above. Also, referring to FIG. 8, instead of the sealing ring 92, a plurality of sealing strips 93 may be attached in spaced-apart manner around the outer surface 88. The features and functions of the sealing strips 93 are the same as those of the sealing strip 31 described above.

Referring now to FIGS. 2 and 5, the mug assembly 60 is assembled by first positioning the decorative mat 64 inside the external mug 62 adjacent the inner surface 72. The internal mug 66 is then positioned inside the external mug 62 so that the mat 64 is positioned in the gap G3 between the outer surface 88 of the internal mug 66 and the inner surface 72 of the external mug 62. To secure the internal mug 66 inside the external mug 62, the internal mug 66 is inserted into the interior of the external mug 62 until the annular sealing ring 92 (or sealing strips 93) is fitted inside the annular groove 80 of the inner surface 72 of the external mug 62. The flexibility of the sealing ring 92 (or sealing strips 93) allows it to be pressed against the height H of the inner surface 72 of the external mug 62 before it becomes fitted inside the groove 80. The height H is preferably very small, for example, less than 1/16 inches. When the internal mug 66 is so fitted inside the external mug 62, a relatively tight seal is formed so that the internal mug 66 cannot be easily lifted from the external mug 62 without the use of a certain amount of force.

Further, the increased thickness of the annular lip 91 creates a tight fit with the upper edge 76 of the external mug 62. In particular, the annular lip 91 can be adapted to engage the inner surface 72 along the height H to seal any gap between the two mugs 62 and 66 at the mouth of the assembly 60. If the external mug 62 is made from plastic, its inherent flexibility will allow the annular lip 91 and sealing ring 92 (or sealing strips 93) to be pressed along the height H during installation or removal of the internal mug 66.

As with the mug assembly 10, instead of the decorative mat 64, the individual can fill the external mug 62 with a small volume of water or other liquid, and then sprinkle in a few color particles. The internal mug 66 can then be fitted inside the external mug 62 and secured therein by the method described above so that the ornamental design of this mug assembly would comprise color particles suspended in a liquid in the gap G3 between the two mugs 62 and 66.

To remove or substitute the decorative mat 64, the individual merely uses his or her fingers to slide the internal mug 66 out of the external mug 62, and removes the decorative mat 64. The removal of the internal mug 66 can be easily accomplished because the frictional engagement between the outer surface 96 of the sealing ring 92 (or sealing strips 93) and the surface of the groove 80, although tight, does not require much sliding force to overcome. The flexibility of the plastic container wall 68 allows the annular lip 91 to be slid, without requiring too much force, from its engagement or contact with the inner surface 72. The individual can then install another decorative mat 64 having a different ornamental design or message.

Figure 6:
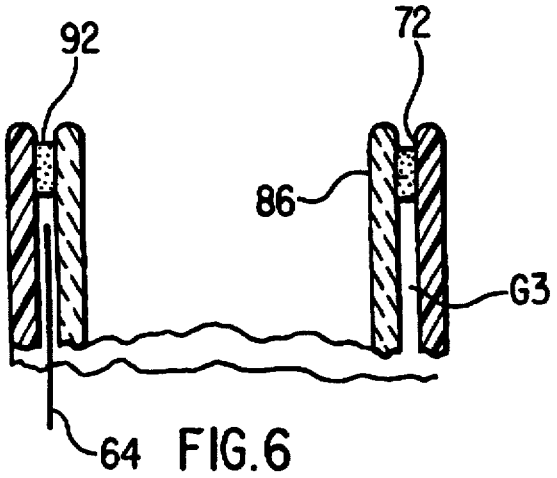
FIG. 6 is a partial cross-sectional view of the mug assembly of FIG. 2 illustrating some modifications made thereto.

It will be appreciated by those skilled in the art that modifications can be made to the mug assemblies 10 and 60 without departing from the spirit and scope of the present invention. For example, in the mug assembly 60 of FIG. 2, the annular groove 80 in the inner surface 72 of the external mug 62 and the annular lip 91 of the internal mug 66 can be omitted. Referring to FIG. 6, the frictional contact between the outer surface 96 of the sealing ring 92 (or sealing strips 93) and the inner surface 72 of the external mug 62 would then be used to secure the internal mug 66 in place inside the external mug 62. The internal mug 66 can be positioned by placing it into the interior of the external mug 62 until the sealing ring 92 (or sealing strips 93) contacts the inner surface 72. A gentle pushing force will be sufficient to overcome the friction between the sealing ring 92 (or sealing strips 93) and the inner surface 72 to press the internal mug 66 completely inside the external mug 62, where it will be secured in place. To remove the internal mug 66, the user merely slides the internal mug 66 out of the external mug 62. Again, the removal of the internal mug 66 can be easily accomplished because the frictional engagement between the outer surface 96 of the sealing ring 92 (or sealing strips 93) and the surface of the groove 80, although tight, does not require much sliding force to overcome.

As another example, the shapes and sizes of the internal and external mugs of the mug assemblies 10 and 60 are not critical, as long as the corresponding internal and external mugs assume substantially the same shape and size so that the internal mug can be fitted inside the external mug.

As a further example, the sealing material is not limited to the sealing rings and sealing strips described hereinabove, as other sealing materials can be used without departing from the spirit and scope of the present invention.

As yet a further alternative, an ornamental design may be provided directly on the outer surface 42 and 88 of the internal mugs 16 and 66, so that the decorative pieces 14 and 64 can be omitted. In this manner, an individual may purchase a number of different internal mugs having different ornamental designs and messages, all adapted to fit the external mug.

Therefore, the novelty mug assemblies of the present invention provide a non-plastic internal mug that can be effectively secured to an external mug. The non-plastic internal mug is made from a material which overcomes the drawbacks of plastic. For example, the non-plastic internal mug can be easily and effectively washed after it has been detached from the external mug, does not carry an unpleasant odor, is effective in retaining the temperature of the fluid contained in the mug, and is less susceptible to cracks or other deformities. Because of its simple design and construction, the mug assemblies are also easy to manufacture and easy to use. Further, the materials used to fabricate the internal and external mugs are inexpensive, so that the mug assemblies can be provided at low cost to the public.

While the description above refers to particular embodiments of the present invention, it will be understood that many modifications may be made without departing from the spirit thereof.

What is claimed is:

1. A mug assembly, comprising:

an external mug comprising a substantially cylindrical container wall having an inner surface, the external mug further comprising a mouth having a substantially circular upper edges, and an annular groove provided in the inner surface adjacent to the upper edge;

an internal mug adapted to be positioned inside the external mug, the internal mug comprising a substantially cylindrical container wall having an outer surface and a substantially circular upper edge, the internal mug further comprising a sealing material attached adjacent the upper edge of the internal mug on the outer surface thereof, the sealing material adapted to engage a portion of the inner surface of the external mug and adapted to be fitted inside the annular groove of the external mug, the sealing material having an outer surface that is adapted to frictionally engage the annular groove and the inner surface of the external mug to secure the internal mug to the mouth of the external mug;

wherein the diameter of the outer surface of the internal mug is smaller than the diameter of the inner surface of the external mug so that a second gap is defined when the internal mug is positioned inside the external mug; and wherein the internal mug is made of a non-plastic material.

2. The assembly of claim 1, wherein the external mug is made from a substantially transparent material.

3. The assembly of claim 2, further comprising a decorative piece having an ornamental design provided thereon, the decorative piece positioned between the inner surface of the external mug and the outer surface of the internal mug.

4. The assembly of claim 2, further comprising a plurality of color particles suspended in a liquid captured between the outer surface of the internal mug and the inner surface of the external mug.

5. The assembly of claim 2, further comprising an ornamental design provided on the outer surface of the internal mug.

6. The assembly of claim 1, wherein the internal mug further comprises an annular lip adapted to engage the inner surface of the external mug adjacent the mouth of the external mug when the internal mug is positioned inside the external mug.

7. The assembly of claim 6, wherein the internal mug is made from a material selected from the group consisting of ceramic, porcelain, earthenware, stoneware or glass.

8. A mug assembly, comprising:

an external mug comprising a substantially cylindrical container wall having an outer surface and an inner surface, the external mug further comprising a mouth having a substantially circular upper edge, and at least one strip of sealing material attached adjacent to the upper edge of the external mug on the outer surface thereof, the sealing material having a flat outer surface;

an internal mug adapted to be positioned inside the external mug, the internal mug comprising a substantially cylindrical container wall having an outer surface and a mouth, the internal mug further comprising an annular overhanging lip extending from its mouth, the overhanging lip comprising a flat internal surface substantially parallel to the outer surface of the internal mug, the overhanging lip adapted to overhang the upper edge of the external mug and defining a first gap which is adapted to engage the mouth of the external mug;

wherein the flat outer surface of the sealing material is adapted to frictionally engage the flat internal surface of the overhanging lip to secure the internal mug to the mouth of the external mug;

wherein the diameter of the outer surface of the internal mug is smaller than the diameter of the inner surface of the external mug so that a second gap is defined when the internal mug is positioned inside the external mug; and wherein the internal mug is made of a non-plastic material.

9. The assembly of claim 8, wherein the external mug is made from a substantially transparent material.

10. The assembly of claim 9, further comprising a decorative piece having an ornamental design provided thereon, the decorative piece positioned between the inner surface of the external mug and the outer surface of the internal mug.

11. The assembly of claim 9, further comprising a plurality of color particles suspended in a liquid captured between the outer surface of the internal mug and the inner surface of the external mug.

12. The assembly of claim 9, further comprising an ornamental design provided on the outer surface of the internal mug.

13. The assembly of claim 8, wherein the internal mug is made from a material selected from the group consisting of ceramic, porcelain, earthenware, stoneware or glass.

14. The assembly of claim 8, wherein the sealing material comprises an annular sealing ring.

15. The assembly of claim 8, wherein the sealing material comprises a plurality of sealing strips.

16. The assembly of claim 1, wherein the sealing material has a flat outer surface adapted to frictionally engage a portion of the inner surface of the external mug.

* * * * *